United States Patent [19]

McEntire et al.

[11] Patent Number: 5,038,019

[45] Date of Patent: Aug. 6, 1991

[54] HIGH TEMPERATURE DIFFUSION FURNACE

[75] Inventors: William D. McEntire, Sonora; Ronald E. Erickson, Modesto, both of Calif.

[73] Assignee: Thermtec, Inc., Campbell, Calif.

[21] Appl. No.: 475,741

[22] Filed: Feb. 6, 1990

[51] Int. Cl.[5] ..... F27D 11/02; H05B 3/66

[52] U.S. Cl. ..... 219/390

[58] Field of Search ..... 219/390, 549, 528; 338/270

[56] References Cited

U.S. PATENT DOCUMENTS

| | | | |
|---|---|---|---|
| 2,398,874 | 4/1946 | Weyhing | 219/390 |
| 3,299,196 | 1/1967 | Lasch | 219/390 |
| 3,361,863 | 1/1968 | Lang | 219/390 |
| 4,147,888 | 4/1979 | Sato | 219/390 |
| 4,159,415 | 6/1979 | Williams | 219/390 |
| 4,596,922 | 6/1986 | Erickson | 219/390 |
| 4,885,454 | 12/1989 | LaVoie | 219/390 |

*Primary Examiner*—Teresa J. Walberg

*Attorney, Agent, or Firm*—Fliesler, Dubb, Meyer & Lovejoy

[57] ABSTRACT

The furnace 70 includes a heating element 72 which is restrained from growth during operation of the furnace 70 by retaining spacers 84 which provide a yoke 88 around the individual coils 102 of the heating element 72 and which spacers 84 are interlocked with each other. A high alumina fiber insulation 180 is applied to insulate the heating element 72. This high alumina fiber insulation 180 has enhanced properties with respect to shrinkage and devitrification.

23 Claims, 8 Drawing Sheets

HIGH TEMPERATURE DIFFUSION FURNACE

FIELD OF THE INVENTION

The present invention is directed to a high temperature diffusion furnace such as that used in the semiconductor industry to heat semiconductor wafers so that, for example, the wafers can be doped with an appropriate material.

BACKGROUND OF THE INVENTION

High temperature diffusion furnaces are well known to the semiconductor industry. Heat treatment in high temperature diffusion furnaces is a part of the manufacturing process for silicon wafers whereby, for example, doping elements such as boron can be introduced into the molecular structure of the semiconductor material. Heating cycles for the furnaces must be controlled accurately with respect to time and temperature. There is also a requirement that the diffusion furnace be made durable enough to withstand repeated heating and cooling cycles. Further, for purposes of the manufacturing processes, it is important that the diffusion furnace quickly reach the desired temperature, maintain the temperature for a preselected period of time and then quickly reduce the temperature to the desired level.

Furnace Design

All of the above requirements dictate that the design of the diffusion furnace have the goals of (1) reducing the mass of the diffusion furnace and (2) exposing the heating elements as much as possible so that the maximum desired temperatures are achievable and so that the mass of the furnace does not unduly effect efficient operation. Further, it is important that the mass of the furnace be sufficient to insulate the rest of the environment. Additionally, the heating elements should be adequately positioned and restrained so that they do not grow as described hereinbelow and so that the heating elements do not fail, requiring costly replacement and resulting in damage to semiconductor products.

In actual practice the diffusion furnaces used in the semiconductor industry are substantially cylindrical in shape. All diffusion furnaces are equipped with a process tube in which the silicon wafers are processed. The process tube is fabricated of quartz, polysilicon, silicon carbide or ceramic. The processing tube 21 is inserted into the diffusion furnace as shown in FIG. 1

The silicon wafers to be heat treated are mounted into boats, fabircated of quartz, polysilicon, silicon carbide or ceramic, and loaded either manually or automatically into the process tube.

The existing diffusion furnaces 20 include an outer metallic housing 22, usually comprised of stainless steel or aluminum and inner layers 24 of insulating materials such as a ceramic fiber. Several helical heating elements 26, 28 and 30 are secured together to form one continuous element with the middle heating element 28 operated at the optimal temperature and the end heating elements 26, 30 operated to a temperature sufficient to overcome losses out the end of the furnace and to preheat any gases being introduced into the furnace. The heating element is generally a helically coiled resistance wire made of a chrome-aluminum-iron alloy. The wire is generally heavy gauge (0.289 inches to 0.375 inches in diameter) for longer heating element life at an elevated temperature.

The maximum permissible operating temperature for the heating element alloy is 1400° C. Since a temperature differential exists between the heating element and the inside of the process tube, diffusion furnaces are normally operated at a maximum operating process chamber temperature of 1300° C.

Heating Element Spacers

Ceramic spacers, such as spacers 32 and 34 as shown in FIGS. 2, 3 and 4 are used to separate and hold in place the individual coils, turns or loops of the helical heating element. Maintenance of the correct separation between each coil or turn is critical to the operation of the furnace which normally require a maximum temperature differential of no more than $\pm\frac{1}{2}$° C. along the entire length of the center zone. Electrical shorting between turns and interference with uniform heat distribution can result if the gaps between the turns or loops changes.

As shown in FIG. 2, a first type of spacer 32 is known as a comb type spacer. This comb type spacer defines a plurality of recesses 38, each of which can receive a turn or individual coil of the helical heating element. Multiple spacers 32 are butted together along the length of the furnace 20 in order to support the entire length of the helical heating element. Further, as can be seen in FIG. 5, the ceramic spacers 32 are positioned circumferentially about the internal diameter of the diffusion furnace 20 in order to support the coil circumferentially.

FIG. 3 depicts an individual type spacer 34 which is also used with helical heating elements. As can be seen in FIG. 4, where multiple spacers 34 are held together in order to hold the helical heating element in place, each individual spacer 34 defines first and second wire retention recesses 40, 42. Each of these recesses defines half of a cavity for retaining a loop of wire of the heating element. Thus, as can be seen in FIG. 4, loop 44 is retained between the wire retention recess 40 and the wire retention recess 42 of two adjacent individual spacers 34. These spacers 34 abut against each other.

Generally the insulation 24 is comprised of a ceramic fiber insulating material having 50% alumina and 50% silica. This insulating material is applied to the exterior of the heating element after the turns are positioned within the spacers. The insulation is applied either as a wet or dry blanket wrapped around the heating element or is vacuum formed over the element. After the insulation has dried, it keeps each spacer and in combination with the spacer, each turn or coil of the helical heating element properly aligned.

It is known that after furnaces are placed in service and generally after eight to ten hours of operation at a minimum temperature of about 1000° C., that an aluminum oxide coating forms over the surface of the heating elements. The aluminum oxide layer or coating is beneficial in that it retards thermal elongation of the heating element at high temperatures, prevents contaminants from collecting on the surface of the heating elements and protects the heating element from excessive oxidation.

As can be seen in FIG. 1, at either end of the furnace 20 is a vestibule 46, 48. At either end of the furnace are vestibules 46, 48. The vestibules 46, 48 are counterbored to accept end blocks 60, 62 which are sized to fit the process tube 21. The process tube 21 is suspended between the end blocks 60, 62. The boats 54 containing the silicon wafer 56 are loaded into the process tube 21 for processing. The boats 54 may be slid manually or automatically into the process tube 21 or suspended within the process tube on cantilevered support arms 59 constructed of silicon carbide or ceramic and quartz.

As indicated above, the operating temperature of the furnace is generally over 1000° C. The furnace cycles between temperatures of approximately 800° C. when the boats are loaded into the furnace process tube and over 1000° C. during full operation. Precise temperature control over the length of the furnace is critical. Also as indicated above, it is imperative that the furnaces quickly come to the operating temperature and quickly cool down after operation.

Failure of these prior furnaces 20 is due to the inability of the furnaces to control the growth or expansion of the heating element, the inability to prevent failure of the ceramic fiber insulation, the inability of the spacers to properly maintain the spacing of the individual coils of the heating element, and the combined effect of these occurrences resulting in coil sag. With coil sag, individual coils touched together and short or touch the processing tube, causing either a short to occur if the tube is made of a conductive material or causing the tube to break should the tube be made of quartz or ceramic.

Heating Element Growth

With respect to growth of the heating elements 26, 28, 30, it is to be understood that the aluminum oxide layer formed on the exterior of the elements has a lower coefficient of expansion than the element alloy itself. As the temperature of the elements goes down, the aluminum oxide layer and the elements both contract, but of course not at the same rate. The lower coefficient of expansion of the aluminum oxide layer causes tensile stresses to form in the heating elements and compressive stresses to form in the aluminum oxide layer. Similarly, when the temperature goes up, the oxide layer and the elements both expand, but again at different rates. The lower coefficient of expansion of the aluminum oxide layer causes compressive stresses to form in the heating element and tensile stresses to form in the aluminum oxide.

These stresses cause two effects. First it is to be understood that the aluminum oxide layer has a low resistance to tensile stress. Thus as the temperature increases, the aluminum oxide layer develops cracks. The cracks in the aluminum oxide layer reduce the layers ability to retard wire elongation. Second, each time the temperature of the element exceeds 1000° C., a new oxide forms. The new oxide fills the cracks in the original aluminum oxide layer, thereby looking into the heating element, the initial growth. This phenomena of aluminum oxide cracking, heating element growth and the subsequent filling in of the cracks repeats with each temperature cycle. Extreme and rapid temperature changes increase the number of fractures in the aluminum oxide layer.

The higher the operating temperature of the heating element, the greater the thermal expansion of the heating element which also further increases the cracking of the aluminum oxide layer. As the number of fractures in the oxide layer increases, the growth of the heating element accelerates. As can be understood, the growth of the heating element is a major cause of premature heating element failure in such diffusion furnaces and in particular in the high temperature, large diameter furnaces due to heating element sagging.

Insulation

Further accelerating the failure of the diffusion furnace 20 is the failure of the insulating material. The ceramic fiber used in the insulating material which holds the spacers in place also has certain characteristics that contribute to the failure of the furnace and in particular, the failure of the heating element. First the insulation shrinks at high temperature. At 1000° C., the shrinkage is approximately 0.4%, while at 1300° C. the shrinkage can exceed 3.0%. Secondly, the insulation devitrifies at elevated temperatures. Devitrification means that the fibers of the ceramic insulation breakdown and become crystalline in structure. Third, the fibers loose resiliency at approximately 500° C. Resiliency is the ability of the fibers to spring back after compression. Resiliency is 80% at a temperature of approximately 480° C. Loss of resiliency accelerates at temperatures over 480° C. and at 900° C. resiliency is only about 50%.

Heating Element Failure

As the temperature of the furnace increases, so does the growth of the heating element, and also the rate of devitrification, shrinkage and loss of resiliency in the insulation. As the coils grows, they rub against the insulation breaking the ceramic fibers into powder. The powdering of the insulation destroys its ability to retard the growth of the heating element and can additionally contaminate the furnace with the powdery material. Eventually, the combination of the coil growth and the insulation failure allows the ceramic spacers, which hold the individual coils of the heating element in place, to loosen. With degradation of the insulation and thus the ability of the insulation to maintain the position of the spacers, the individual spacers can fall out from between the individual coils allowing further growth, distortion and kinking of the heating element. The weight of the heating element itself, then can cause the element and the spacers to sag resulting in failure as indicated hereinabove.

Current spacer designs, as shown by the prior art spacers of FIGS. 2 and 3, are not satisfactorily effective in extending the life of the heating element. The individual type spacer (FIG. 3) is more effective than the comb type spacer (FIG. 2) in keeping the coil within the recesses. Once, however, the integrity of the insulation is compromised, these individual spacers can come out of alignment with respect to the adjacent spacers.

The use of more spacers could be effective in physically restraining the coil. However, the use of additional spacers adds mass around the heating element. With more mass around the heating element, the heating element becomes less responsive to the heating and cooling cycles required for semiconductor manufacture. Some prior art devices have attempted to cement the coil with respect to the spacers. This has, however, increased the temperature differential between the heating element and the portion of the chamber where the wafers are positioned. This temperature differential means that the furnace may not be able to reach appropriate temperature levels for the manufacturing operation.

SUMMARY OF THE INVENTION

The present invention is directed to overcoming the disadvantages of the prior art. The purpose of the present invention is to provide a rigid support system for the coiled heating element which can reduce the growth of the heating elements to acceptable levels. This support system must be effective in the high temperature environment of a diffusion furnace.

Accordingly, the present invention includes a heating element retention spacer for an electric furnace having an electric heating element configured as an elongate wire which the spacer comprises a first mechanism for providing a yoke about the elongate wire in order to hold the position of the elongate wire relative to the furnace, and a second mechanism for interlocking said spacer to another of said spacer.

The first yoke mechanism includes first and second spaced projections extending in a first direction and the second interlocking mechanism includes third and fourth spaced projections extending in a different direction. The spacing of the first and second projections and the spacing of third and fourth projections are selected so that the first and second projections of the yoke mechanism of the spacer can fit between the third and fourth projections of the second interlocking mechanism of another spacer. Thus one spacer is interlocked to the next spacer and a yoke is provided around each wire of the heating element in order to effectively position the wire and prevent sag or other movement of the wire.

The invention further includes an electric furnace having an electric heating element and insulation covering the heating element. The insulation includes a first layer placed adjacent to the heating element which is comprised of at least 75% alumina and 25% silica. Another layer which includes about 50% alumina and 50% silica is placed over the first layer.

In a preferred embodiment, the first layer is comprised of at least 95% alumina and 5% silica and a second layer comprised of at 95% alumina and 5% silica is positioned between the first and another layer.

Thus it is an object of the present invention to provide a furnace which has an extended life and the ability to operate through a multiplicity of high temperature cycles.

It is another object of the present invention to provide a furnace which is of low mass so that appropriate temperatures can be reached in the furnace.

It is a further object of the present invention to provide for a furnace which can appropriately restrain growths of the heating element.

It is yet another object of the present invention to provide for insulation which can withstand the high temperature cycles without degrading and thus extend the life of the heating element and the furnace.

DETAILED DESCRIPTION OF THE PREFERRED EMBODIMENTS

Figure 12:
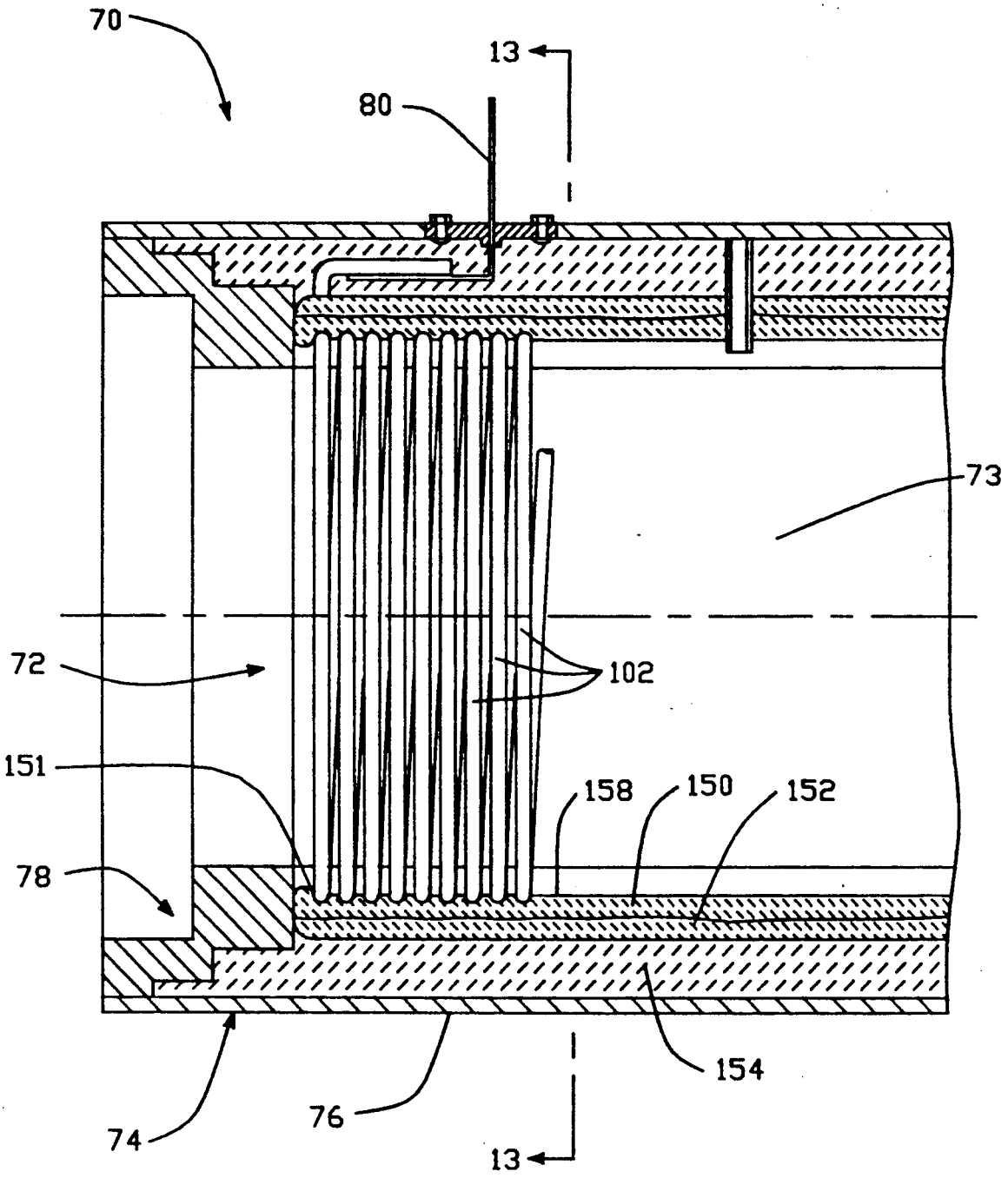
FIG. 12 depicts a side cross-sectional view of a furnace of the invention.
Figure 13:
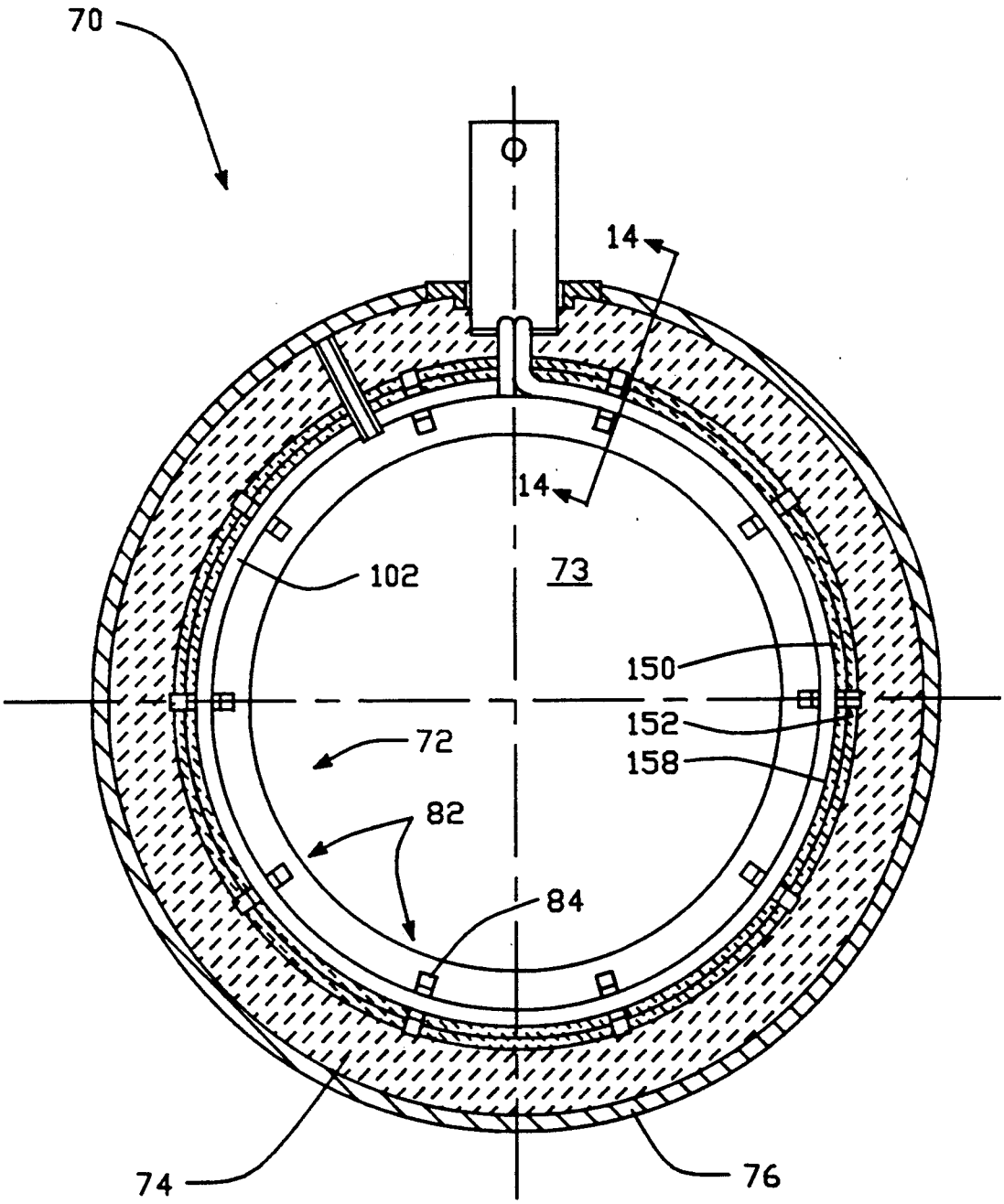
FIG. 13 depicts a cross-sectional view of the furnace taken along line 13—13.

A furnace 70 of the invention is generally depicted in FIGS. 12 and 13. Furnace 70 includes a heating element 72 which is surrounded by insulation 74, which insulation is surrounded by a housing 76. As can be seen in FIG. 12, the furnace ends in a vestibule 78. An electrical connector 80 is provided through the housing 76 so that appropriate electrical leads can be connected to the furnace in order to provide the appropriate current to the heating element 72. It is to be understood that this type of furnace which is used as a diffusion furnace in the semiconductor industry is a low voltage, high amperage furnace operating in a current range of between 70–130 amps.

As can be seen in FIG. 13, ten rows 82 of spacers 84 are provided substantially equally spaced circumferentially about the helical heating element 72. The spacers, which will be described more fully hereinbelow, are used to maintain the position of the individual loops or coils 102 of the heating element 72. The larger the diameter of the furnace the more rows 82 of the spacer 84 are required to maintain the position of the heating element 72. Thus generally four rows of spacers are used with a heating element having an internal diameter of between three and five inches, six rows of spacers are used with a heating element having an internal diameter of between five and eight inches, eight rows of spacers are used with a heating element having an internal diameter of between eight and ten inches, ten rows of spacers are used with a heating element having an internal diameter of between ten and twelve and one-half inches, twelve rows of spacers are used with a heating element having an internal diameter of between twelve and one-half and fifteen inches and fourteen rows of spacers are used with a heating element having an internal diameter of greater than fifteen inches.

Figure 1:
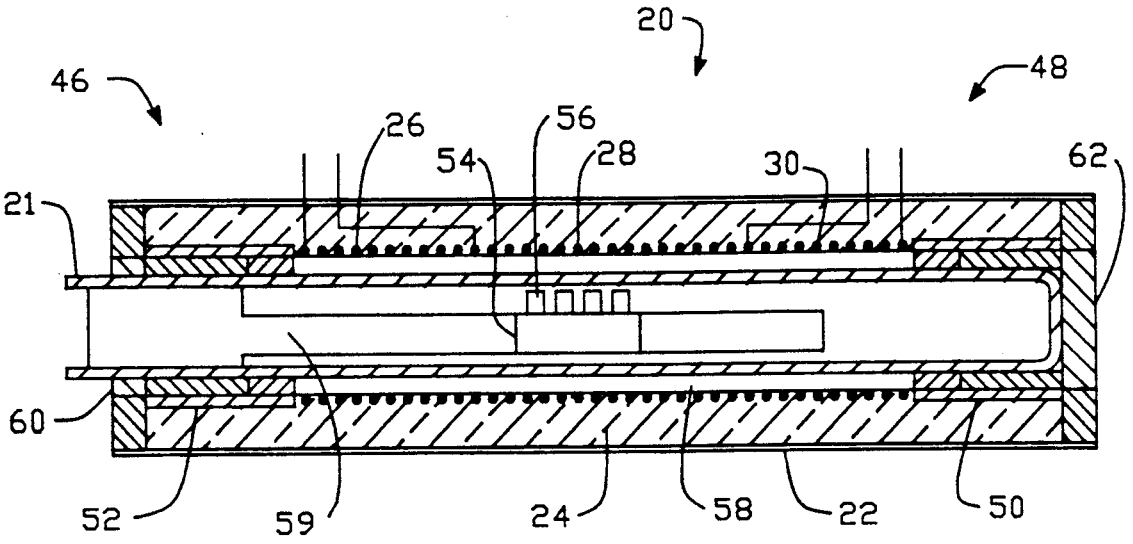
(PRIOR ART) FIG.-1
FIG. 1 depicts a side sectional view of a prior art furnace.
Figure 2:
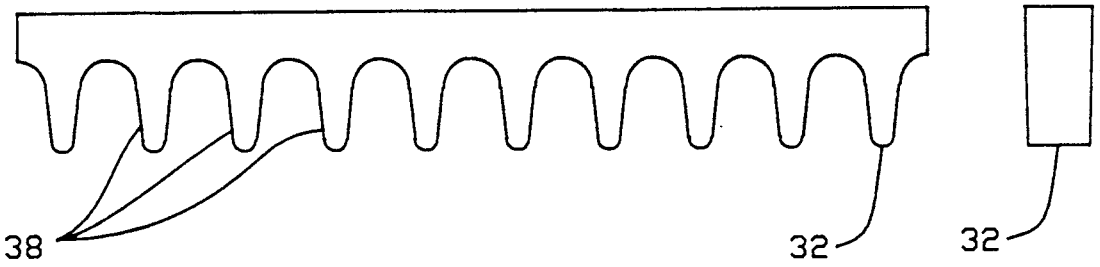
(PRIOR ART) FIG.-2
FIG. 2 depicts a side and an end view of a prior art comb type spacer.
Figure 3:
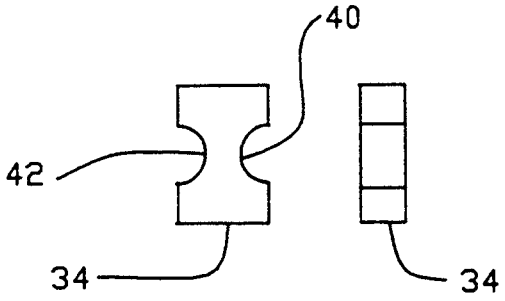
(PRIOR ART) FIG.-3
FIG. 3 depicts side and an end view of a prior art individual type spacer.
Figure 4:
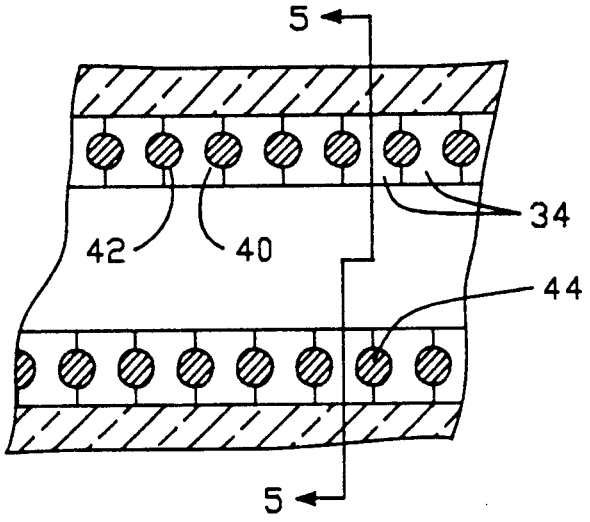
(PRIOR ART) FIG.-4
FIG. 4 depicts a partial cross-sectional view similar to that presented in FIG. 1 of a prior art furnace using the individual type spacers of FIG. 3.
Figure 5:
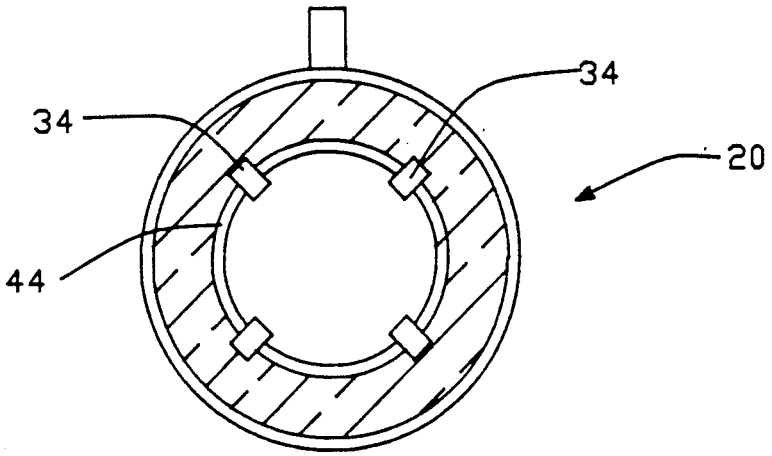
(PRIOR ART) FIG.-5
FIG. 5 depicts a cross-sectional view taken through line 5—5 of FIG. 4.
Figure 6:
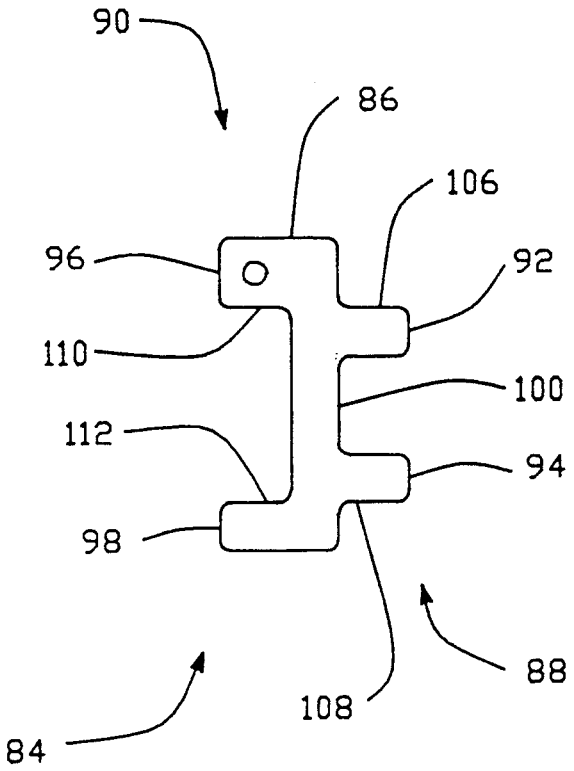
FIG. 6 depicts a side view of an embodiment of the spacer of the invention.
Figure 7:
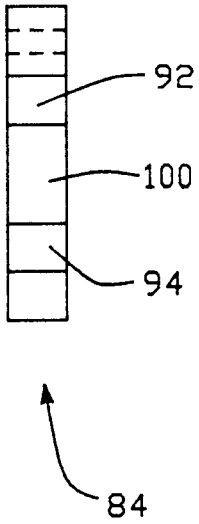
FIG. 7 depicts an end view of the embodiment of FIG. 6.
Figure 14:
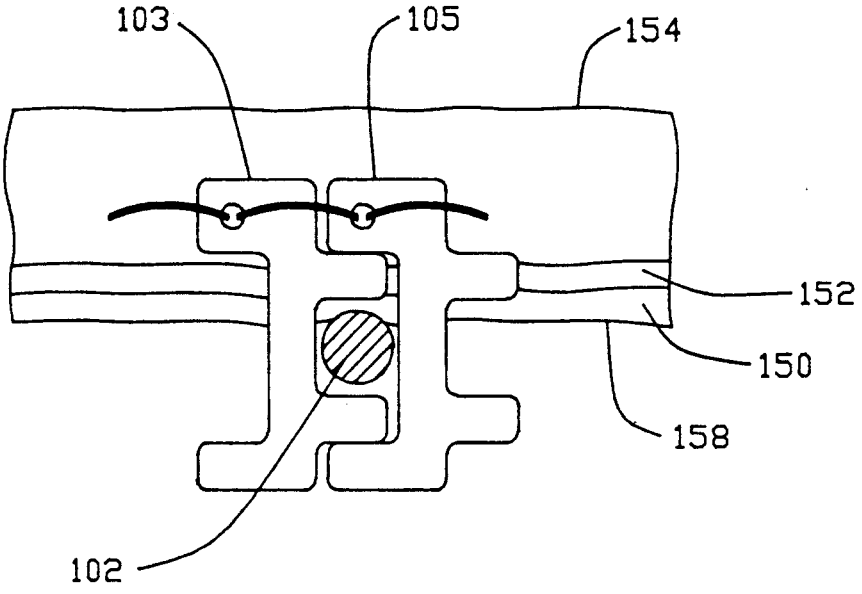
FIG. 14 depicts an enlarged view of several spacers of the invention containing a wire of the heating element that is embedded in the insulation.

The specific design of the spacer 84 can be more fully viewed in FIGS. 6, 7 and 14. In FIG. 6 the spacer 84 includes an elongate central body 86. Projecting in a first direction from the central body 86 is a first yoke mechanism 88. Extending in a second direction from central body 86 is a second interlocking mechanism 90. Yoke mechanism 88 includes first and second projections 92, 94 which in a preferred embodiment are substantially parallel and extend in a first direction. Second interlocking mechanism 90 includes third and fourth projection 96, 98 which are substantially parallel and extend in a direction which is 180° opposite from the first and second projections 92, 94. First and second projections 92, 94 as well as third and fourth projections 96, 98 in a preferred embodiment are all parallel to each other. The first and second projections 92, 94 of yoke mechanism 88 defined therebetween a U-shaped recess 100 which can receive individual coil or loop 102 of the heating element 72.

Figure 8:
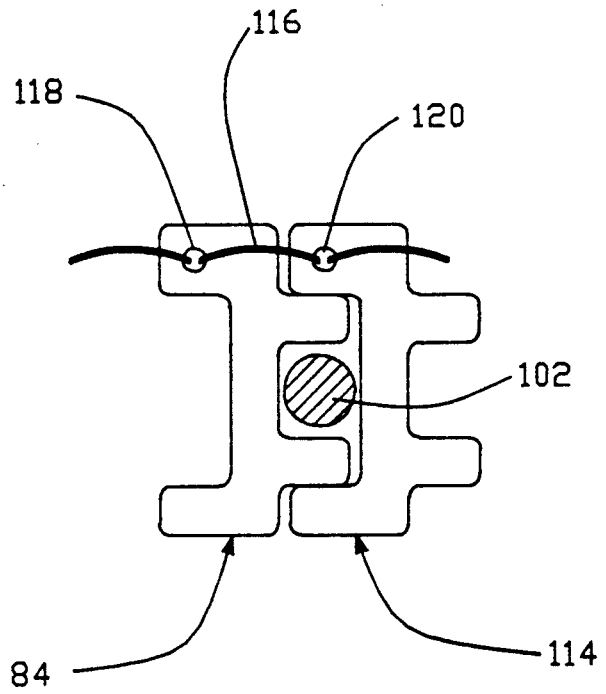
FIG. 8 depicts spacers in accordance with FIGS. 6 and 7 which have been linked together.

First and second projections 92, 94 define outer side 106, 108 while third and fourth projections 96, 98 define inner sides 110, 112. As can be seen in FIG. 8, the spacing between outer side 106, 108 is less than the spacing between inner sides 110, 112 so that a yoke mechanism 88 of one spacer, such as spacer 84, can fit into an interlocking mechanism 90 of a adjacently positioned spacer 114. Within the configuration as shown in FIG. 8, the yoke mechanism 88 and the interlock mechanism 90 cooperate to hold the coil or loop 102 in place. Further, even during heating, should expansion occur in the furnace, the ceramic spacers 84, 114 can slip relative to each other and still maintain the interlocking relationship. Thus when cooling occurred, the loop 102 would still be appropriately maintained in an advantageous position.

To further ensure the positioning of spacer 84 adjacent spacer 114 a high temperature thread can be used to lace or stitch the spacers together. This thread 116 is threaded or laced through ports 118, 120 provided in ceramic spacers 84, 114. In a preferred embodiment, this thread could include a 3M product sold under the trade name "NEXTEL".

Figure 9:
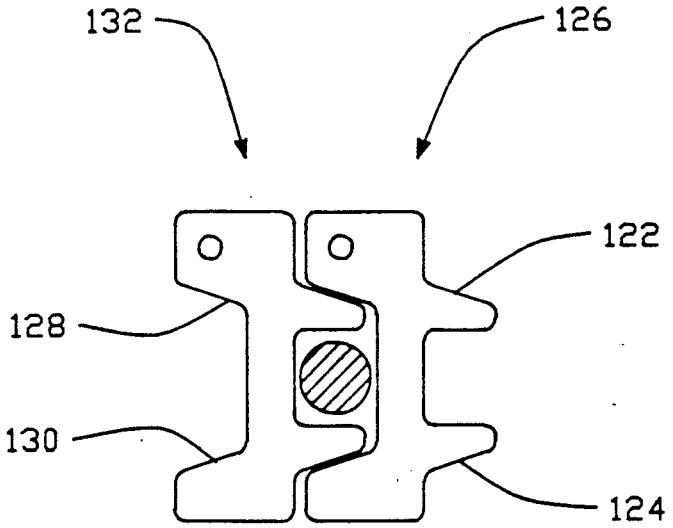
FIGS. 9, 10, and 11 depict other embodiments of spacers of the invention which are linked together.
Figure 10:
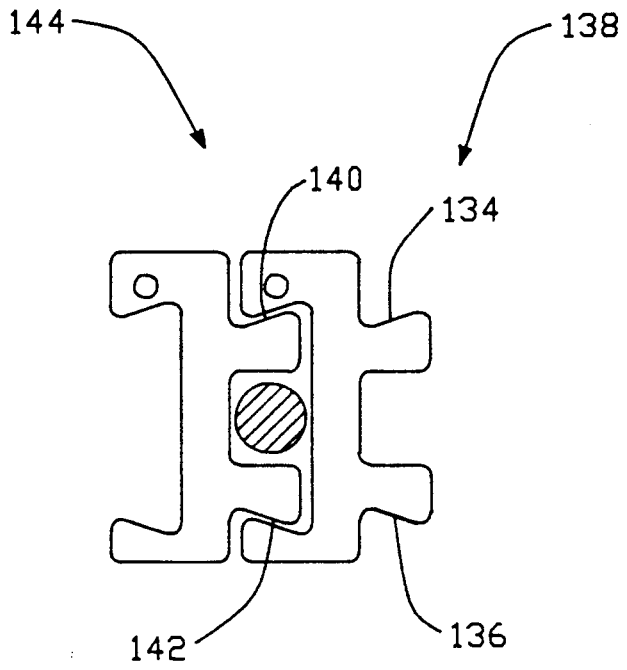
Figure 11:
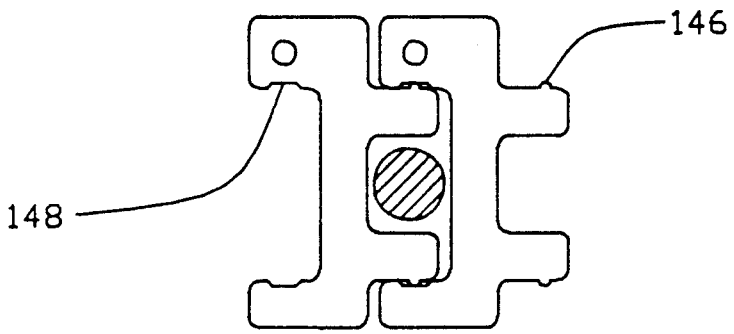

Other embodiments of the spacers of the invention are shown in FIGS. 9, 10 and 11. In FIG. 9, the external walls of the first and second projections 122, 124 of the yoke end 126 are slanted inwardly with a correspondingly inward slants on the inner walls of the third and fourth projections 128, 130 of the interlocking mechanism 132. Such an arrangement eases the task of inserting one spacer to the next.

In FIG. 10, the outer sides of the first and second projections 134, 136 of the yoke mechanism are outwardly slanted with the inner sides of the third and fourth projections 140, 142 of the interlocking mechanism outwardly slanted. Such an arrangement has the distinct advantage that once adjacent spacers are positioned in an interlocking manner as shown in FIG. 10, expansion of the heating element will not pull these spaces apart unless the expansion forces are great enough to break the ceramic spacers. Such an arrangement would be somewhat more difficult to assemble than the arrangements of FIGS. 8 and 9 due to the fact that the spacers would have to be assembled by sliding them laterally with respect to each other.

FIG. 11 depicts yet a further embodiment of the spacer wherein interlocking bumps 146 fit into races 148 to secure the yoke mechanism of one spacer to the interlocking mechanism of an adjacent spacer. Assembly of such an arrangement would be similar to that require by the embodiment of FIG. 10. Some expansion is allowed in this embodiment as the bumps 146 can move in the races 148 allowing adjacent spacer to move relative to each other.

Turning to FIGS. 12, 13 and 14 the insulation of the invention is depicted. In a preferred embodiment after the heating element 72 is formed, a first thin layer of insulation is provided over the heating elements 72. This insulation is comprised of at least 75% alumina and 25% silica. In a preferred embodiment, the optimal combination is at least 95% alumina and 5% silica, three-fourths of an inch thick. This thin insulation layer can be formed in a number of ways, including wet and dry processes known in the industry. In a wet process, a blanket of material is formed and then strips of the blanket are laid lengthwise along the heating element between the spacers. A second layer is then used to cover the first layer and the spacers.

Alternatively, this insulation layer can be vacuum formed onto the heating element. As can be seen in FIGS. 12, 13 and 14 the first layer 150 partially covers the spacers 103, 105 and partially encases part of the outer periphery of the coil 102 which is directed away from the heating chamber. If the insulation is formed as a wet blanket, a roller tool is used to press the insulation between the spacers and the loops of heating element 72. As can be seen in FIG. 13, the end of the insulation is wrapped around the end of the coil 151.

Again in a preferred embodiment a second thin layer of insulation material 152 is applied in a longitudinal but overlapping manner over the first layer of insulation material. In this preferred embodiment the second insulating layer is at least 75% alumina and 25% silica. Preferably and optimally the second insulating layer is at least 95% alumina and 5% silica. After this second layer is applied in a manner similar to that above described, third and subsequent layers 154 are applied over the first and second layers. These subsequent layers are comprised of conventional insulating material which includes 50% alumina and 50% silica. Once this has been accomplished, the housing 76 which in a preferred embodiment is comprised of stainless steel is applied over the outer layer of insulation 154 in such a way as to compress the insulation from a density of about ten pounds per square foot to a density of about fourteen to eighteen pounds per square foot. This compression holds the heating element, spacers, and insulation together as a rigid unit. If the insulation has been applied as a wet blanket, the heating elements are energized in order to dry out the insulation.

High alumina insulation, as that specified above, exhibits no shrinkage below 1200° C. and shrinkage of only approximately 1% at 1300° C. The high alumina formulation also retains 80% resiliency at 930° C. and 50% resiliency at 1260° C. It is to be understood that the present bulk alumina/silica material with 95% alumina and 5% silica is effective to a temperature of 1650° C. In contrast, bulk material which is comprised of 50% alumina and 50% silica is only effective to 1300° C.

A disadvantage of high alumina fiber is however that it currently costs approximately twenty-six times more than the currently used 50% alumina and 50% silica formulation. Consequently, the layer of high alumina insulation is only thick enough to minimize shrinkage to acceptable levels.

In a preferred embodiment, with a furnace 70 having a heating element with a ten inch internal diameter, preferably the first and second layers of insulation would each be approximately three-quarters of an inch thick with the subsequent layers of insulation being a total of two to three inches thick. It is to be understood that high alumina fiber material is commercially available. To this alumina material deionized water and binder which is usually comprised of colloidal silica is added. Only as much binder as is needed to hold the bulk ceramic fiber insulation together is added. From this slurry wet blankets can be formed, cut to the desired shapes, and then applied to the heating elements 72. It is to be understood that a normal slurry of alumina/silica material would be mixed with 90% deionized water and 10% binder to comprise 100 gallons of fluid. To this four pounds of fiber would be added to make the appropriate slurry.

As with prior art devices, it is highly desirable that a zircon layer be added to strengthen the high alumina fiber first insulation layer. Zircon is comprised of a slurry of zirconia oxide, water and a binder. Zircon is a very dense refractory material which can resist the abrasive actions of the heating element as it expands and contracts. The zircon layer 158 is coated onto the first layer of insulation material 150 before that is applied to the heating element 72. The zircon layer 158 is generally about 1/32 to 1/16 inch thick. Because the zircon layer is so thin, it does not significantly add mass to the heating element nor interfere with the heating characteristics of the element. The zircon layer 158 completely surrounds the heating element 72 and acts to contain any insulation powder resulting from fiber devitrification or abrasive action due to the expansion and contraction of the heating element 72. This powder is trapped between the zircon layer 158 and the third and subsequent layers of insulation 154. Without a zircon layer 158 encasing the insulation, insulation powder will fall into and contaminate the heating chamber 73.

It is to be understood that as with prior devices, the newly formed furnace is heated in order to dry the wet insulation. As heating occurs, the binder which initially holds the insulation together migrates to the surface of the insulation adjacent to the heating element 72 and gives the surface of the first layer greater rigidity while additionally hardening the zircon layer 158.

It can be seen that with the present invention, that a rigid structure is provided for resisting growth of the heating element while allowing the heating element to be exposed so that the heating element is highly efficient in giving off heat to heat the heating chamber.

Industrial Applicability

The operation of the invention is as outlined above. It can be seen that with the use of the interlocking spacer, which provides a yoke around each of the coils of the heating element, and with the combination of the high alumina insulation material, that a furnace is provided which has an enhanced life due to the restraints placed on the growth of the heating element. With this arrangement higher operating temperatures can be reached due the use of the selected materials themselves and also due to the fact that the temperature differential between the heating element and the heating chamber is not as great as with prior art devices as more of the heating element is exposed and as the mass of the furnace is kept to a minimum. Further the time and temperature of each duty cycle can more accurately maintained with this design.

It is to be understood that other objects and advantages of the present invention can be obtained from a review of the figures and the claims.

Other embodiments of the present invention can be derived which fall within the spirit and scope of the present invention as claimed.

I claim:

1. An electric furnace having a electric heating element and insulation covering said heating element, the furnace comprising:

said insulation having:

at least a first layer placed adjacent to heating element which is comprised of at least 75% alumina and the remainder silica; and at least another layer placed adjacent the first layer which is about 50% alumina and 50% silica.

2. The electric furnace of claim 1 wherein:

said first layer is comprised of at least 95% alumina and the remainder silica.

3. The electric furnace housing of claim 1 wherein:

said first layer is thinner than the another layer.

4. The electric furnace of claim 1 including a second layer positioned between the first layer and the another layer, which second layer is comprised of at least 75% alumina and the remainder silica.

5. The electric furnace of claim 4 wherein the first layer and the second layer are thinner than the another layer.

6. The electric furnace of claim 1 wherein the heating element is formed of a wire having a preselect diameter and wherein said first layer has been positioned to partially envelope the diameter of the wire.

7. The electric furnace of claim 1 wherein:

said first layer is comprised of at least 95% alumina and the remainder silica.

8. An electric furnace having a heating element comprised of an elongate wire formed into a plurality of individual coils comprising:

a plurality of heating element retention spacers for keeping the coils of said wire spaced apart;

each of said spacer including:

(a) first means for providing a yoke about the wire of each coil;

(b) a second means for interlocking one of said spacers to another of said spacers in order to maintain the position of each coil relative to the next adjacent coil and relative to the furnace; and insulation means for covering, insulating and assisting in the positioning of the heating element including:

(a) at least a first layer placed adjacent to the heating element which is comprised of at least 75% alumina and at least the remainder silica; and (b) at least another layer placed adjacent the first layer which is about 50% alumina and 50% silica;

so that the spacers and said insulation means confine growth of said electric heating element as said electric furnaces is repeatedly used.

9. The electric furnace of claim 8 including:

an initial layer of zircon placed between the first layer and the heating element, which initial layer is thinner than the first layer; and an external housing means for encasing and compressing said insulation means.

10. The heating element retention spacer of claim 8 wherein the first means is for additionally cooperating with the second means in order to hold the position of the elongate wire relative to the furnace.

11. The heating element retention spacer of claim 8 wherein:

said first means includes first and second spaced projections extending in a first direction; and said second means includes third and fourth spaced projections extending in a second direction.

12. The heating element retention spacer of claim 11 wherein:

said first and second spaced projections and said third and fourth spaced projections are substantially parallel.

13. The heating element retention spacer of claim 11 wherein:

said first direction is opposite to said second direction.

14. The heating element retention spacer of claim 11 wherein:

the spacing of the first and second projections and the spacing of the third and fourth projections are selected so that the first and second projections of the first means of the spacer can fit between the third and fourth projections of the second means of another of said spacer.

15. The heating element retention spacer of claim 8 wherein:

said spacer has a body;

said first means includes first and second projections which define therebetween a cavity adapted for receiving the wire;

said first and second projections have outer sides which are external to said cavity and which have a certain orientation with respect to said body;

said second means having third and fourth projections which therebetween define another cavity for receiving the first and second projections of another of said spacer;

wherein said third and fourth projections have internal sides which define said another cavity and which have another certain orientation with respect to said body so that with the spacer interlocked with said another spacer, the outer side of the first projection is substantially parallel to the internal side of the third projection, and the outer side of the second projection is substantially parallel to the internal side of the fourth projection.

16. The heating element retention spacer of claim 8 wherein:

said first means includes retention spacer of second projections which define therebetween a cavity for receiving the wire;

said second means includes third and fourth projections which define therebetween another cavity for receiving the first and second projections of another spacer.

17. The heating element retention spacer of claim 9 including means for allowing a plurality of said spacers to be secured together.

18. The heating element retention spacer of claim 8:

a bore;

means for interconnecting said bore to the bores of a plurality of said spacers.

19. The electric furnace of claim 8 wherein:

said first layer is comprised of at least 95% alumina and the remainder silica.

20. The electric furnace of claim 8 wherein:

said first layer is thinner then the another layer.

21. The electric furnace of claim 8 including a second layer positioned between the first layer and the another layer, which second layer is comprised of at least 75% alumina and the remainder silica.

22. The electric furnace housing of claim 21 wherein the first layer and the second layer are thinner than the another layer.

23. The electric furnace of claim 8 wherein the heating element is formed of a wire having a preselect diameter and wherein said first layer has been positioned to partially envelope the diameter of the wire.

* * * * *

UNITED STATES PATENT AND TRADEMARK OFFICE

CERTIFICATE OF CORRECTION

PATENT NO. : 5,038,019

DATED : August 6, 1991

INVENTOR(S) : William D. McEntire, et al.

It is certified that error appears in the above-identified patent and that said Letters Patent is hereby corrected as shown below:

Column 12, line 1, "retention spacer of" should read -- first and --.

Signed and Sealed this

Ninth Day of February, 1993

*Attest:*

STEPHEN G. KUNIN

*Attesting Officer*

*Acting Commissioner of Patents and Trademarks*